US006775961B2

(12) United States Patent
Cook et al.

(10) Patent No.: US 6,775,961 B2
(45) Date of Patent: Aug. 17, 2004

(54) WEB TENSIONING DEVICE

(75) Inventors: Peter William Cook, Cambridgeshire (GB); Christopher Brunning, Lincolnshire (GB)

(73) Assignee: ITW LTD (GB)

( * ) Notice: Subject to any disclaimer, the term of this patent is extended or adjusted under 35 U.S.C. 154(b) by 129 days.

(21) Appl. No.: 10/112,060

(22) Filed: Apr. 1, 2002

(65) Prior Publication Data

US 2002/0152729 A1 Oct. 24, 2002

(30) Foreign Application Priority Data

Apr. 19, 2001 (GB) ..... 0109646

(51) Int. Cl.[7] ..... B65B 11/02; B65B 53/00

(52) U.S. Cl. ..... 53/556; 53/588; 53/204; 53/210; 53/389.4

(58) Field of Search ..... 53/210, 204, 588, 53/587, 556, 211, 389.4; 100/12, 13, 27, 28

(56) References Cited

U.S. PATENT DOCUMENTS

| | | | | |
|---|---|---|---|---|
| 2,057,061 A | * | 10/1936 | Eggerss | 53/137.2 |
| 4,322,262 A | * | 3/1982 | Cottam | 156/392 |
| 4,413,463 A | * | 11/1983 | Lancaster | 53/556 |
| 4,418,510 A | * | 12/1983 | Lancaster et al. | 53/587 |
| 4,545,182 A | | 10/1985 | McDowell, Jr. | |
| 4,553,374 A | | 11/1985 | Lancaster et al. | |
| 4,862,678 A | * | 9/1989 | Humphrey | 53/556 |
| 5,282,347 A | | 2/1994 | Cleine et al. | |
| 5,414,979 A | * | 5/1995 | Moore et al. | 53/556 |
| 5,447,009 A | | 9/1995 | Oleksy et al. | |
| 5,755,083 A | | 5/1998 | Cleine | |
| 5,829,234 A | | 11/1998 | Suolahti | |
| 5,904,094 A | * | 5/1999 | Bredenberg | 101/216 |
| 6,006,498 A | | 12/1999 | Cleine | |

FOREIGN PATENT DOCUMENTS

| | | |
|---|---|---|
| DE | 19954007 | 12/2000 |
| EP | 0 220 712 | 5/1987 |
| EP | 0 544 312 | 6/1993 |
| EP | 0 936 141 A1 | 8/1999 |

* cited by examiner

*Primary Examiner*—Stephen F. Gerrity
(74) *Attorney, Agent, or Firm*—Lowe Hauptman Gilman & Berner LLP

(57) ABSTRACT

A device for tensioning web, such as a plastics web dispensed from a shuttle in a wrapping machine, is disclosed. The wrapping machine usually includes an endless track positioned about an object to be wrapped and the shuttle travels on the endless track, dispensing the web as it goes. The rate at which web is dispensed varies as the shuttle progresses around the track and is dependent upon the shape of the track and the shape of the object to be wrapped. The web tensioning device attempts to maintain a constant tension in the web and includes a pair of rollers covered with resilient material. The rollers are urged together to form a nip with the resilient covering of the rollers compressed in the nip. The web is fed between the nip of the rollers.

17 Claims, 2 Drawing Sheets

WEB TENSIONING DEVICE

TECHNICAL FIELD

This invention relates to web tensioning devices for machines which apply a generally helical winding of a wrapping web by using a shuttle which contains a supply of the wrapping web and which moves around a track defining a closed path. The invention particularly relates to axial winding of a wrapping web in which the closed path of the track passes through an opening of an object to be wrapped.

BACKGROUND OF THE INVENTION

In machines of the type described above, relative movement is established between the object to be wrapped and the closed path around which the shuttle moves. Such machines can be used to apply a wrapping to elongate articles or bundles of elongate articles and especially can be used for wrapping annular or toroidal products such as steel coils. In this case the track is either formed in two halves as described in U.S. Pat. No. 5,755,083 or includes a gate as shown in U.S. Pat. No. 5,282,347 to enable the coil to be positioned such that the track goes through the centre of the coil and around the outside of the coil. The track is usually arranged to be fixed in space and the coil arranged to be rotated about its axis so that, as the shuttle moves around the track, axial wrapping takes place so that a generally helical winding of packaging web is applied around the outside of the annular coil and through its centre aperture.

The rate of removal of the web from the shuttle varies as the shuttle moves around the track and depends upon the size of the object. Again taking the case of steel coils, these usually have a standard centre aperture but the width of the steel sheet and the length of the sheet (and therefore the diameter of the coil) often vary from coil to coil and thus the generally rectangular cross-section of the coil being wrapped varies from coil to coil. To accommodate such variations most shuttles include some form of brake mechanism to brake the unwinding of the web supply reel and an accumulator to hold a supply of web to allow it to be taken at an irregular rate. To enable such shuttles to fit through the centre of a steel coil the shuttle and track must be made as small as reasonable and it would be desirable to avoid an accumulator on the shuttle. Some attempts have been made to do this in, for example, U.S. Pat. No. 5,829,234 in which the shape of the track is varied to provide a substantially uniform rate of removal of the web from the shuttle and so avoid the need for an accumulator on the shuttle.

When the web is tensioned by using a simple reel brake then the tension in the web varies with the radius of the supply reel and therefore the tension in the wrapping varies as the web is dispensed from the supply reel. It has been proposed in EP-A-0936141 to provide a variable brake for the supply reel, a tension sensor for sensing the tension in the web downstream from the supply reel and, feedback means to control the supply reel brake in response to the sensed tension to maintain the tension substantially constant. Similar feedback arrangements are used on large scale fixed web feeding systems used with printing presses and film reeling machines, but it is difficult to use such techniques in a shuttle moving around a closed path. Typically, the power to drive a shuttle round such a closed path is taken from wiper contacts on the shuttle which engage conductor rails located around the track. The use of sophisticated control circuitry relying on such wiper contacts is difficult to implement in practice.

SUMMARY OF THE INVENTION

According to a first aspect of this invention a web tensioning device for a shuttle applying a generally helical winding includes a pair of substantially rigid idle rollers covered with resilient material and urged against one another to form a nip with their resilient covering compressed in the nip and with the web being fed between the nip of the rollers.

We have found that such a simple arrangement provides a substantially constant tension in the wrapping web that does not vary with the radius of the supply reel or vary significantly with the rate of unreeling of the wrapping web. This arrangement certainly provides results which are very much better than those of a simple supply reel brake and is much easier and cheaper to implement than the systems involving a variable braking effort on the supply reel.

Such web tensioning devices can be used with a machine as described in EP-A-0936141 where the shape of the track is varied to provide a substantially constant rate of unreeling of the wrapping web and thus not require an associated web accumulator. However, it is preferred that the shuttle also includes a web accumulator downstream of the web tensioning device to enable the shuttle to cope with changes in the instantaneous rate of web supply from it.

Preferably, the rollers have a hollow or solid steel core with a covering of rubber or rubber-like elastomeric material, the rubber or rubber-like elastomeric material may be a vulcanised natural or synthetic rubber or a thermoplastic elastomer such as polyurethane. Preferably, the resilient covering is heat resistant since substantial quantities of heat can build up in the rollers at high web throughput rates. Preferably, the covering has a Shore hardness of between 70 and 75 and a specific gravity of between 1.14 and 1.20. The core of the rollers can have a diameter from between 25 to 100 mm and a covering thickness in a range of 8 to 4 mm, respectively.

Preferably, the rollers are mounted in a box frame construction consisting of two side plates and stretchers which form the body of the shuttle, the journal bearings for one of the rollers being mounted on slides in the side plates and including adjusters such as jack-screws to urge the one roll towards the other. Preferably, a web supply roll on a web supply reel is urged against the up-stream roller or the up-stream roller is urged against the web supply roll to control the unwinding of the web from the roll and it does not allow the supply roll to freewheel.

In a second aspect, the invention consists in a shuttle for carrying a web material adapted to be applied in a generally helical winding, the shuttle including a web tensioning device according to the first aspect.

In a third aspect, the invention consists in wrapping apparatus for applying a wrapping web to an article, the wrapping apparatus including an endless track arranged about the article to be wrapped and upon which at least one shuttle according to the second aspect travels.

BRIEF DESCRIPTION OF THE DRAWINGS

A particular example of a web tensioning device in accordance with this invention will now be described with reference to the accompanying drawings; in which.

DETAILED DESCRIPTION OF THE PREFERRED EMBODIMENT

Figure 3:
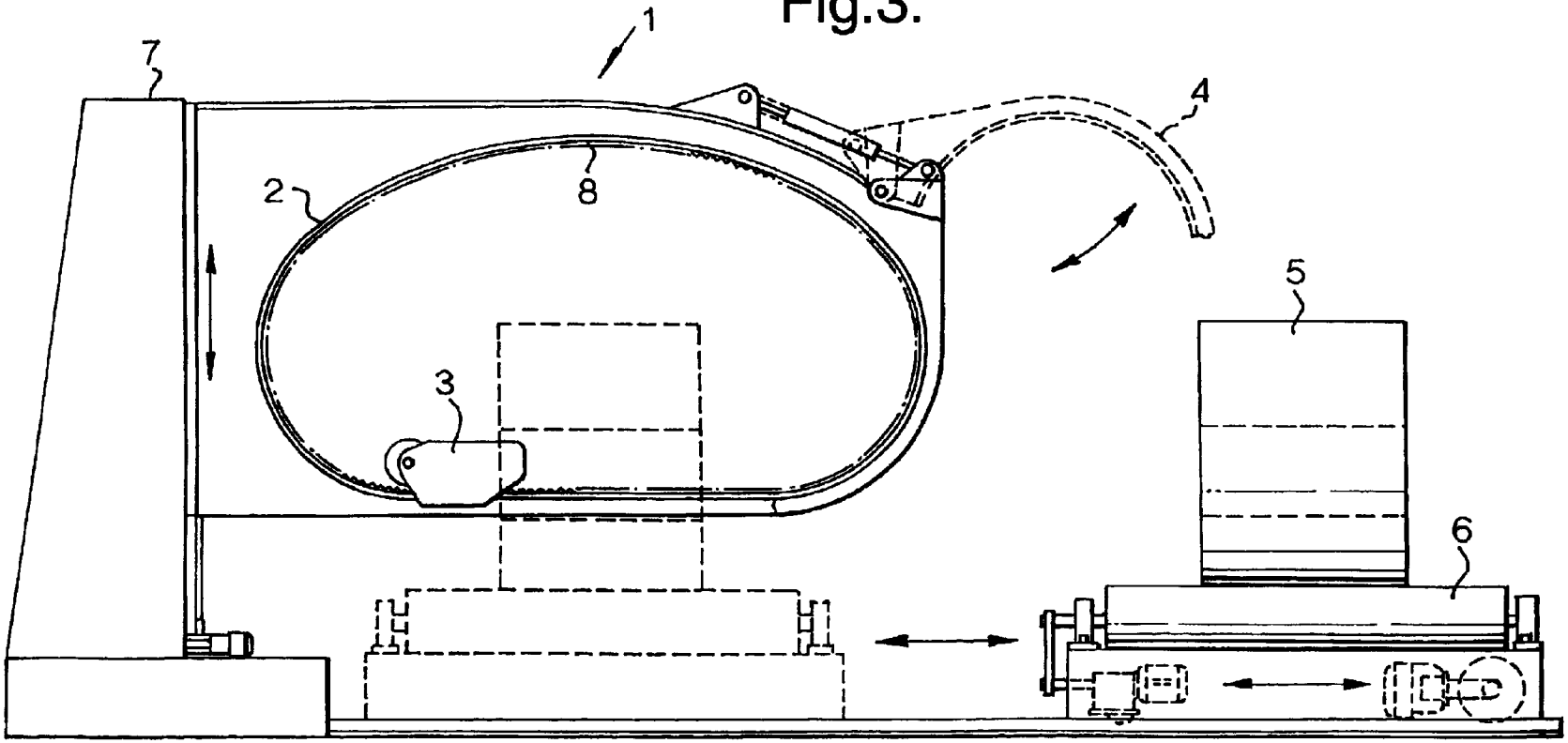
FIG. 3 is a side elevation of a wrapping apparatus for use in wrapping coils of steel which includes the shuttle of FIG. 2.

With reference initially to FIG. 3, a wrapping apparatus 1 is shown comprising an endless looped track 2 about which a wrapping shuttle 3 travels. An endless rack 8 is provided on the inner surface of the endless track 2. A section 4 of the track is movable away from the remainder of the track in order to allow an article to be wrapped, for example a coil 5 of sheet steel, to be positioned for wrapping and also to allow for removal or replacement of the wrapping shuttle 3. The coil 5 is provided on a movable platform 6 for positioning the coil with its central hole surrounding a section of the track 2 and also for rotating the coil during wrapping. The height of the looped track 2 is also adjustable on a columnar support 7 to cater for different sized coils.

The wrapping apparatus of FIG. 3 is merely one example of a wrapping apparatus suitable for use with the web tensioning device according to the present invention which is described below. Other types of wrapping apparatus could alternatively incorporate the present web tensioning device, such as that disclosed in U.S. Pat. No. 5,755,083 in which the endless track is formed in two symmetrical "U" shaped parts which are movable towards and away from each other. Furthermore, while the wrapping apparatus is shown in use wrapping a coil of sheet steel, other articles not having a central opening, such as bundles of pipes, timber or metal extrusions may just as easily be wrapped.

Figure 2:
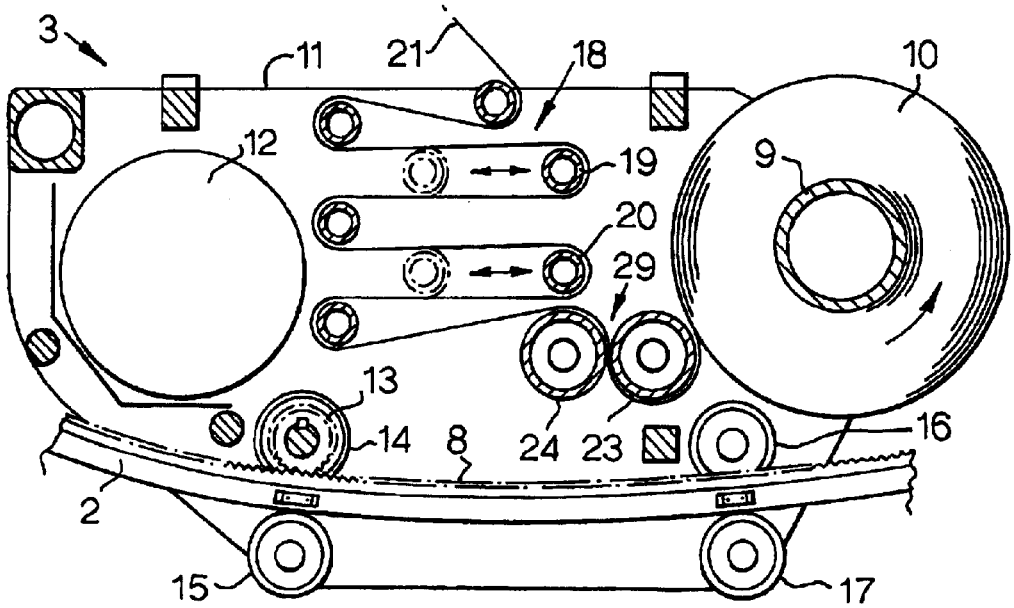
FIG. 2 is a cross-sectional side elevation of a shuttle including the web tensioning device of FIG. 1.

With reference now in particular to FIG. 2, the workings of a particular embodiment of shuttle 3 are shown. The shuttle 3 similar to that described in, for example U.S. Pat. No. 5,755,083, including a roll 10 of wrapping medium 21 such as a roll of plastics stretch web or film mounted on a supply reel 9. More preferably, the wrapping medium comprises a film such as that sold under the Trade Mark VALCROSS by Illinois Tool Works Inc. which is an inherently substantially non-stretchable cross-laminated strength film.

The roll 10 of wrapping medium 21 protrudes from one end of a shuttle body 11 comprising a box frame having two side plates separated by stretchers. An electric motor 12 is mounted within the shuttle to drive a pinion 13 engaged with the rack 8. The motor 12 may be energised by way of wiper contacts on the shuttle contacting rigid electric supply conductors positioned within the wrapping apparatus, beneath the surface of and around the perimeter of track 2. Freewheeling side wheels 14 to 17 maintain the shuttle on the track.

An accumulator 18 may be provided within the shuttle 3 to effectively "store" excess wrapping medium 21 within the shuttle should the rate at which it is fed from the roll 10 temporarily be greater than the rate at which it is applied around the article being wrapped. The accumulator comprises an array of rollers, some of which (19, 20) are movable under spring tension as is conventionally known. However, as previously mentioned, the accumulator 18 is not essential to the operation of the present invention.

Figure 1:
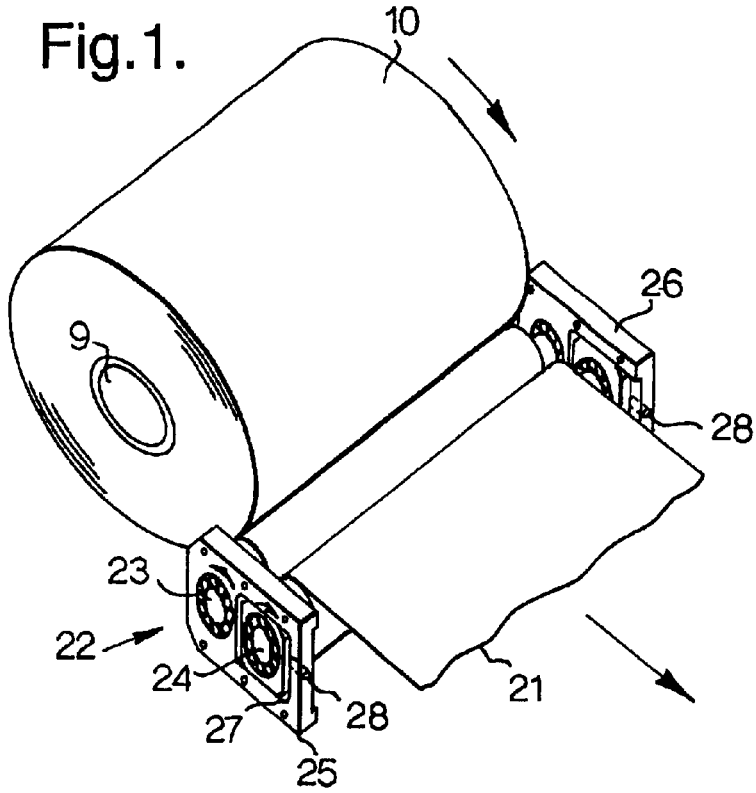
FIG. 1 is a perspective view of a web tensioning device according to the present invention in use about a wrapping web.

A web tensioning device 22 is also included within the shuttle 3. The tensioning device is shown out of the shuttle in FIG. 1 for clarity and includes a pair of substantially rigid idle rollers 23 and 24. The ends of rollers 23 and 24 are mounted in cassette holders 25 and 26 so that the axes of the rollers are parallel. Roller 23 is rotatable within roller bearings in cassette holders 25 and 26, but is not otherwise movable with respect to the cassette holders. Roller bearings also rotatably support roller 24 within cassettes 25 and 26 however the roller bearings are mounted in a slide channel 27 so that the axis of roller 24 may be moved towards or away from the axis of roller 23. Adjustment means such as jack screws 28 are provided in the free ends of the cassette holders to allow user adjustment of the distance between the axes of rollers 23 and 24.

The wrapping medium 21 is wound under roller 23, between rollers 23 and 24 and then on to the accumulator 18 or out of the shuttle and directly on to the article to be wrapped. The rollers 23 and 24 may be, for example, 260 mm in length and 45 mm in diameter including an outer approximately 5 mm coating of natural rubber material over a hollow or solid steel core. Accordingly, roller 24 may be adjusted so that its coated surface is in contact with the covered surface of roller 23, through the wrapping medium 21. The two coatings are then deformed, thereby providing a nip 29 through which the wrapping medium 21 is dispensed. It is anticipated that the rollers will be required to endure significant heat build up. The thickness of the roller outer covering of resilient material could be decreased provided that the diameter of the roller overall was increased to aid in dissipation of the built up heat.

Once the free end of wrapping medium 21 has been secured to an article to be wrapped, subsequent movement of the shuttle around the track causes wrapping medium to be drawn off the roll 10. The nip 29 creates a rolling resistance resulting in tension in the dispensed wrapping material. Adjustment of the jack screws 28 allows this tension in the wrapping medium to be controlled to suit a variety of wrapping medium specifications. In order to avoid the roll 10 freewheeling and unwinding, a slight drag would desirably be provided on the supply reel 9. This could be provided by positioning roller 23 so that its surface contacts the undispensed surface of wrapping medium on roll 10.

We claim:

1. A web tensioning device for a shuttle adapted to apply a generally helical winding of a wrapping web, the web tensioning device comprising a pair of substantially rigid idle rollers each being covered with a covering of resilient material, said rollers being urged against one another to form a nip with the resilient coverings being compressed in the nip and with the web being fed between the nip of the rollers.

2. A web tensioning device as claimed in claim 1, wherein each of the rollers has a hollow or solid steel core with the covering being made of rubber or resilient elastomeric material, and the rubber or resilient elastomeric material is a vulcanized natural or synthetic rubber or a thermoplastic elastomer.

3. A web tensioning device as claimed in claim 1, wherein the resilient covering is heat resistant.

4. A web tensioning device as claimed in claim 1, wherein the resilient covering has a Shore hardness of between 70 and 75 and a specific gravity of between 1.14 and 1.20.

5. A web tensioning device as claimed in claim 1, wherein a rigid core of the rollers has a diameter from between 25 to 100 mm and the resilient covering has a thickness in a range of 8 to 4 mm.

6. A web tensioning device for a shuttle adapted to apply a generally helical winding of a wrapping web, the web tensioning device including a pair of substantially rigid rollers covered with resilient material and urged against one another to form a nip with their resilient covering compressed in the nip and with the web being fed between the nip of the rollers, wherein the web is fed around an up-stream one of the pair of substantially rigid rollers from a web supply roll on a web supply reel;

said web tensioning device further comprising means adapted to urge the up-stream roller against the web supply roll to control unwinding of the web from the web supply roll.

7. The web tensioning device of claim 6, further comprising a jack-screw urging one of the rollers toward the other.

8. A shuttle for carrying a wrapping web to be applied in a generally helical winding, the shuttle comprising a web tensioning device according to claim 1.

9. Wrapping apparatus for applying a wrapping web to an article, the wrapping apparatus comprising an endless track arranged about the article to be wrapped and upon which at least one shuttle according to claim 8 travels.

10. A web tensioning device for a shuttle adapted to apply a generally helical winding of a wrapping web, the web tensioning device including a pair of substantially rigid rollers covered with resilient material and urged against one another to form a nip with their resilient covering compressed in the nip and with the web being fed between the nip of the rollers, wherein the rollers are mounted in a box frame construction consisting of two side plates and stretchers which form a body of the shuttle; and journal bearings for one of the rollers are mounted on slides in the side plates and adjusters are provided to urge the one roller towards the other.

11. A shuttle for carrying a wrapping web to be applied in a generally helical winding, the shuttle comprising:

a body comprising a box frame having two side plates separated by stretchers; and a web tensioning device comprising a pair of substantially rigid rollers each being covered with a covering of resilient material, said rollers being urged against one another to form a nip with the resilient coverings being compressed in the nip and with the web being fed between the nip of the rollers;

wherein the rollers are rotatably mounted in the box frame, and journal bearings of one of the rollers are slidably mounted in the side plates and an adjuster is provided to urge said one roller towards the other roller.

12. The shuttle as claimed in claim 11, wherein said adjuster is a jack-screw.

13. The shuttle as claimed in claim 11, wherein each of the rollers has a hollow or solid steel core with the covering being made of rubber or resilient elastomeric material, and the rubber or resilient elastomeric material is a vulcanized natural or synthetic rubber or a thermoplastic elastomer.

14. The shuttle as claimed in claim 11, wherein the resilient covering is heat resistant.

15. The shuttle as claimed in claim 11, wherein the resilient covering has a Shore hardness of between 70 and 75 and a specific gravity of between 1.14 and 1.20.

16. The shuttle as claimed in claim 11, wherein a rigid core of the rollers has a diameter from between 25 to 100 mm and the resilient covering has a thickness in a range of 8 to 4 mm.

17. The shuttle as claimed in claim 11, wherein the web is fed around an up-stream one of the pair of substantially rigid rollers from a web supply roll on a web supply reel; and said shuttle further comprising means for urging the up-stream roller against the web supply roll to control unwinding of the web from the web supply roll.

* * * * *